US009963268B2

(12) United States Patent
Horn

(10) Patent No.: US 9,963,268 B2
(45) Date of Patent: May 8, 2018

(54) MEDICINE DISPENSING RECORD SYSTEM

(71) Applicant: Kimberlee Ann Horn, Crawfordsville, IN (US)

(72) Inventor: Kimberlee Ann Horn, Crawfordsville, IN (US)

( * ) Notice: Subject to any disclaimer, the term of this patent is extended or adjusted under 35 U.S.C. 154(b) by 64 days.

(21) Appl. No.: 14/459,756

(22) Filed: Aug. 14, 2014

(65) Prior Publication Data

US 2015/0047998 A1 Feb. 19, 2015

Related U.S. Application Data

(60) Provisional application No. 61/866,085, filed on Aug. 15, 2013.

(51) Int. Cl.

| | |
|---|---|
| ***B65D 85/00*** | (2006.01) |
| ***B65D 25/20*** | (2006.01) |
| ***B65D 67/02*** | (2006.01) |
| ***A61J 1/18*** | (2006.01) |
| *A61J 1/03* | (2006.01) |

(52) U.S. Cl.

CPC ..... *B65D 25/205* (2013.01); *A61J 1/18* (2013.01); *B65D 67/02* (2013.01); *A61J 1/03* (2013.01); *A61J 2205/00* (2013.01)

(58) Field of Classification Search

CPC .... B65D 25/205; B65D 51/245; B65D 83/04; B65D 67/02; A61J 7/04; A61J 1/18; A61J 2205/00; A61J 1/03; B43L 27/02; B43K 23/001

USPC ..... 206/459.5, 232, 528, 459.1; 211/60.1, 211/69.1, 69.2

See application file for complete search history.

(56) References Cited

U.S. PATENT DOCUMENTS

| | | | | |
|---|---|---|---|---|
| 630,822 A | | 8/1899 | Bates | |
| 753,457 A | * | 3/1904 | Weissbrod | A47B 23/002 16/DIG. 12 |
| 844,054 A | | 2/1907 | Swope | |
| 1,330,470 A | * | 2/1920 | Jutila | B43L 25/10 206/224 |
| 1,397,079 A | | 11/1921 | Cohen | |
| 1,407,239 A | | 2/1922 | Weiss | |
| 2,165,625 A | * | 7/1939 | Fessel | A44C 5/0046 224/219 |
| 3,996,879 A | * | 12/1976 | Walton | G09F 7/00 116/308 |
| 4,606,484 A | * | 8/1986 | Winter | A46B 5/00 224/218 |

(Continued)

OTHER PUBLICATIONS http://www.namebubbles.com/All-Products/Write-On-Labes/Write-On-Baby-Bottle-Label . . . .

*Primary Examiner* — J. Gregory Pickett
*Assistant Examiner* — Rafael Ortiz
(74) *Attorney, Agent, or Firm* — James Ray and Associates; Alexander Pokot

(57) ABSTRACT

The article of manufacture has a body and an exterior surface on the body that is at least partially configured to receive indicia thereon without binding and/or being absorbed thereby. The article of manufacture may be adapted with a releasable attachment for a marking implement operable to adhere such indicia. The article of manufacture may be configured for an attachment to an exterior surface of a medicine holding container or between the open end of the medicine holding container and a cap provided to selectively cover and uncover the open end.

4 Claims, 9 Drawing Sheets

(56) References Cited

U.S. PATENT DOCUMENTS

| | | | | |
|---|---|---|---|---|
| 5,025,935 | A * | 6/1991 | Hadachek | B63C 11/02 211/60.1 |
| 5,105,949 | A | 4/1992 | Blair | |
| 5,311,689 | A | 5/1994 | Lindsey | |
| 5,794,767 | A * | 8/1998 | Wilson | F23Q 2/34 206/37 |
| 6,752,431 | B1 | 6/2004 | Matthews et al. | |
| 7,971,710 | B1 * | 7/2011 | Zaher | A63B 71/0672 206/216 |
| 8,304,073 | B2 * | 11/2012 | Davies | C09J 7/0296 156/701 |
| 2004/0118022 | A1 * | 6/2004 | Duesler | G09F 23/00 40/324 |
| 2010/0258992 | A1 * | 10/2010 | Schroeder | A63B 43/00 269/3 |
| 2014/0295130 | A1 | 10/2014 | Hirth | |

* cited by examiner

MEDICINE DISPENSING RECORD SYSTEM

CROSS-REFERENCE TO RELATED APPLICATIONS

This application is related to and claims under 35 U.S.C. § 119(e) priority from and benefit of U.S. Provisional Patent Application Ser. No. 61/866,085 filed on Aug. 15, 2013 entitled Medicine Dispensing Record System.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

1. Technical Field

The subject matter relates to tracking at least one of date, time, consumption and/or usage dosage or quantity, and description of contents in a container. It further relates to tracking at least one of date, time, and dosage of medicine.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting factors of any examples in the forgoing detailed description, to anything stated or implied therein or inferred thereupon.

Typically, one of the recommendations to reduce medication errors and harm is to use the "five rights of medicine administration": the right patient, the right drug, the right dose, the right route, and the right time. However, the five rights should be accepted as a goal of the medication process not the "be all and end all" of medication safety. It is important to follow the rules of the five rights of patient medication administration to keep the patient safe and prevent harm. Medical professional errors often occur in the medical field, and utilizing the five rights points can help to avoid these errors.

It is important for every medical professional to be knowledgeable about the medication being given to the patient. It is not possible for every medical professional to know the drug facts on every drug. To be safe and competent, the medical professional should look up unfamiliar drug information before giving the medication to the patient. The patient has the right to information on the medication, the right to receive the correct medication, and the right to have a medical professional knowledgeable in the medication they are providing. Examples of the five rights of medicine administration may include:

Right Patient—Be sure you have the right patient before administering medication; Ask the patient to state their full name.

Right Medication—Check the bottle's label against the physician's authorization; Be sure they match.

Right Dose—Double check the amount of medication before administering; Be sure the amount to be given is clearly understood.

Right Time—Medication is to be given in substantial compliance with the physician's request; Within one half hour before or after the scheduled time.

Right Route—Designated medical professionals are authorized to administer oral medication only; Do not administer ear, eye, nose drops, topical medication, or injected medication.

Typically, medicine may include a special food or a chemical that makes someone better when they are ill. A lot of medicines are liquid and can be bought in a small bottle. Other medicines may come in pills or capsules. The doctor may tell the patient or caregiver how much medicine to take each day. Most medicines cannot be bought unless a doctor (or other authorized professional) has prescribed the medicine for the patient. Often, the doctor or pharmacist provide specific instructions for administering the medicine, including dosages, quantities, and warnings.

Medicine containers may be containers that contain medicine prescribed by doctors. Medicine containers may come in different shapes, sizes, and colors. The most common medicine container may be an orange pill bottle, opaque liquid bottle or a pill box.

Typically, dosage forms are a mixture of active drug components and nondrug components. Depending on the method of administration they come in several types. These are liquid dosage form, solid dosage form and semisolid dosage forms. Various dosage forms may exist for a single particular drug, since different medical conditions can warrant different routes of administration. Additionally, a specific dosage form may be a requirement for certain kinds of drugs, as there may be issues with various factors like chemical stability or pharmacokinetics. The oral and intravenous doses of a medicine may also vary depending on the patient, the strength of the medication, and the severity of the illness.

Often, various dry and/or liquid contents are placed into containers for storage purposes and require tracking of the at least one of content type and/or composition, expiration date, consumption date, preparation date and the like pertinent information.

Therefore, it is still important to provide a cost effective article of manufacture that may be attached onto an exterior surface of the container for tracking contents therwithin.

BRIEF DESCRIPTION OF THE DRAWINGS

The invention will now be described, by way of examples, with reference to the accompanying drawings, in which.

DETAILED DESCRIPTION

Figure 1:
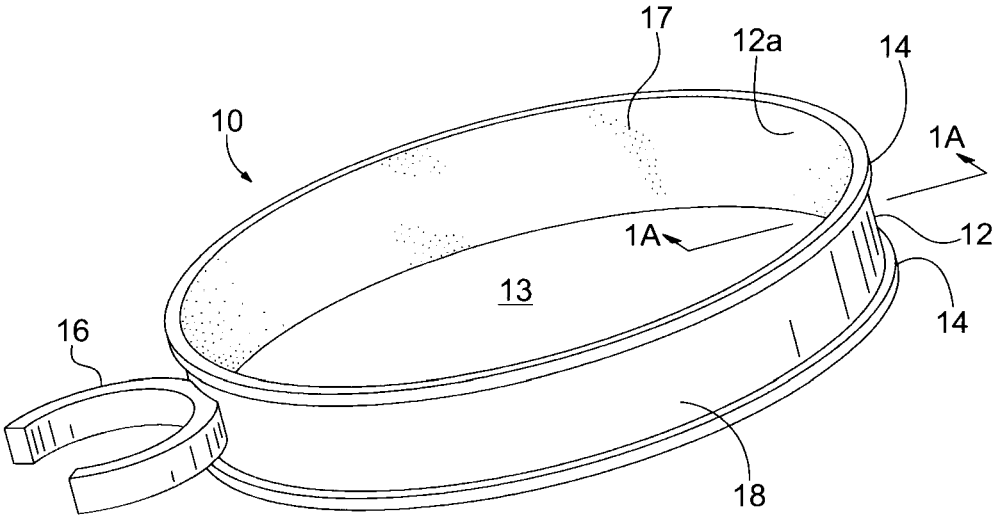
FIG. 1 illustrates a perspective view of a ring shaped article of manufacture with a marked-on surface and a marking implement holder.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in the Figures. Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The subject matter relates to tracking information. The subject matter may relate to tracking at least one of date, time, consumption and/or usage dosage or quantity, and description of contents in a container. The subject matter may generally relate to a medicine dispensing tracking and provides for ease of tracking either date, time and dosage of consumed medicine or the date, time and dosage of to be consumed medicine. The user may also track the name of the medicine content itself. The related information may be recorded in an erasable or permanent manner by any marking or writing implement.

The article of manufacture has an exterior surface at least partially configured sized and/or shaped to receive an indicia thereon without binding and/or being absorbed thereby. The article of manufacture may provide a releasable attachment for a marking implement operable to adhere such indicia.

When concerned with the medicine consumption, the invention provides an article of manufacture configured for an attachment to an exterior surface of a medicine container between the open end of the medicine container or between the container and a cap provided to selectively cover and uncover an open end of the medicine container.

Figure 2:
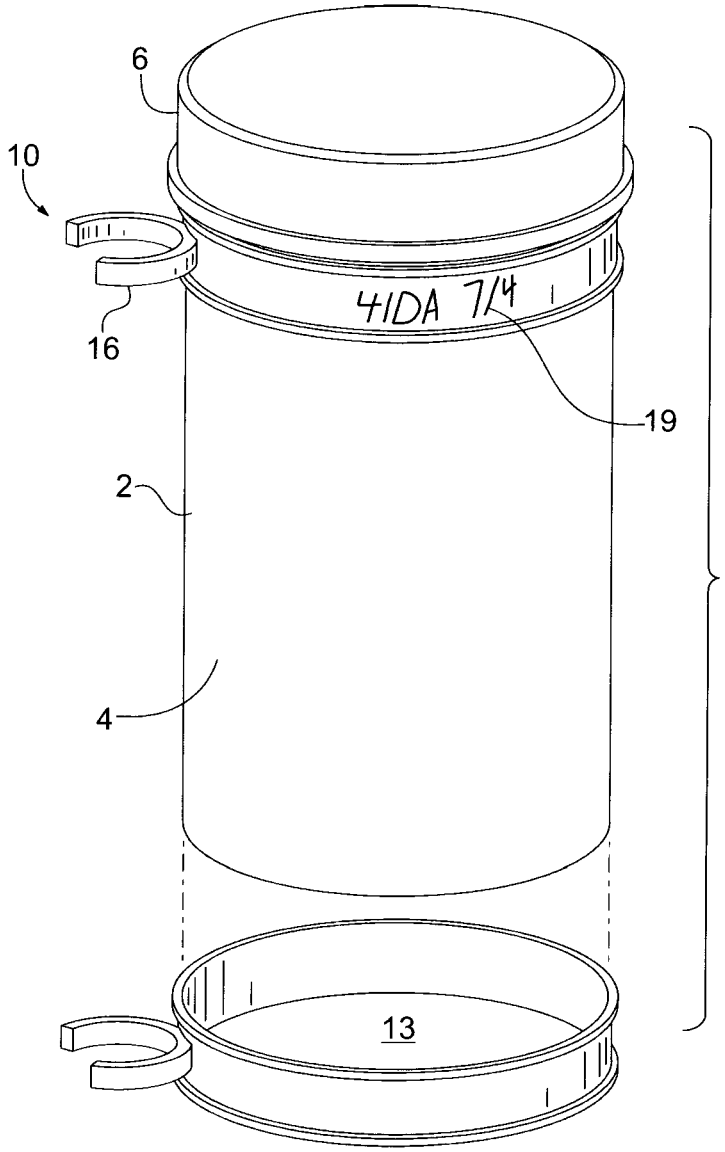
FIG. 2 illustrates an environmental view of the ring shaped article of manufacture of FIG. 1 positioned on an exterior surface of a medicine dispensing container.

Now in a particular reference to FIG. 1, the article of manufacture, generally designated as 10, comprises a body 12 having a hollow interior 13. The body 12 is shown as being configured as an annular, ring-shaped member. It can be seen that the body 12 has an annular cross-section in a plane transverse to the height of the body 12. For the sake of reader's convenience, the height of the body 12 is oriented along a length of the medicine container 2 of FIG. 2. As it may be further seen in FIG. 2, the hollow interior 13 is shaped and sized to fit over an exterior surface 4 of the medicine container 2, shown as a conventional bottle or vial. FIG. 2 also illustrates the body 12 in its use position that may be near the open end of the medicine container 2 and under the cap 6, although other positions along the length of medicine container 2 are also contemplated. The hollow interior 13 may be sized so as to prevent unintended disengagement of the body 12 from the exterior surface 4, yet allow ease of installation and removal of the body 12. By way of one example, the cross-sectional shape of the body 12 in a plane along the length of the medicine container 2 may have a tapered shape. By way of another example, the body 12 may be manufactured from a flexible material. By way of yet another example, at least a portion of the interior surface 12*a* of the body 12 may be coated with a substance/material 17 having anti-slip characteristics that resist sliding linear movement of the body 12. For example such substance/material may be of the type used on handles of conventional hand tools. The material used in manufacturing the body 12 may be solely of the type having such anti-slip properties.

In a further reference to FIG. 1, the article of manufacture 10 may further include one or a pair of flanges or abutments 14 disposed at one terminal edge or both terminal edges of the body 12 respectively and protruding above an exterior surface 18 of the body 12.

The exterior surface 18 of the body 12 may be at least partially configured, sized and/or shaped to receive an indicia identifier 19 thereon without binding and/or being absorbed by the surface 18. In other words, the exterior surface 18 may be at least partially provided as a marking (marked-on) surface configured to receive such indicia identifier 19 that can be simply represented by date, time and/or dosage values. The entire exterior surface 18 may be completely provided as a marked-on surface.

Figure 1A:
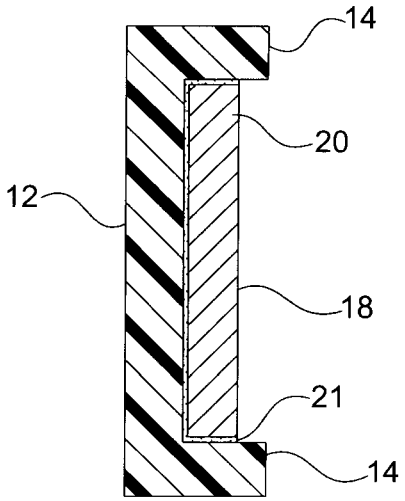
FIG. 1A illustrates an example of a cross-sectional view of the article of manufacture of FIG. 1.

The body 12 may be either entirely manufactured from a material that can be marked on or a separate member 20 carrying such exterior surface 18 may be secured onto the body 12 by any known means, for example such as adhesive 21, best illustrated in FIG. 1A that is illustrated as being applied between the upper and lower edges of the body 20 but that may be applied an inner surface of the body 20 or a combination of such side edges and inner surface. Such means may also include mechanical processes, for example such as clamping, friction fit, molding and the like attachment arrangements.

The raised nature of the flanges or abutments 14 may prevent an unintended erasure of the indicia identifier 19 from the marked-on exterior surface 18.

The article of manufacture 10 may further comprise a clip 16 attached to the exterior surface 18 of the body 12 and configured to releaseably receive a marking implement 80 that is operable to adhere the indicia identifier 19 onto the exterior surface 18. The clip 16 may be positioned either to orient the marking implement 80 device along the length of the medicine container 2 or transverse thereto and tangential to the exterior surface 4 of the medicine container 2, as in the example illustrated in FIG. 5.

The body 12 may be provided as a unitary, one-piece member construction to be wrapped around the exterior surface 4 of the medicine container 2 and sized to sufficiently grasp such exterior surface 4 to prevent unintended separation therefrom.

Figure 3:
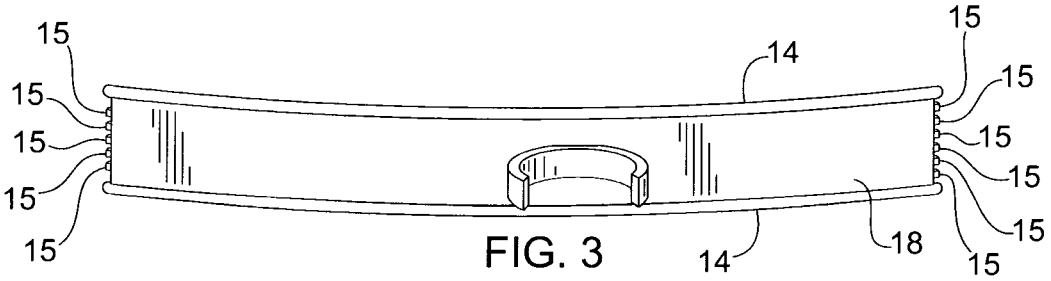
FIG. 3 illustrates one example of the article of manufacture of FIG. 1.

In a particular reference to FIG. 3, the body 12 may be provided as a band-like shape to be wrapped around the exterior surface 4 of the medicine container 2 and having ends configured to be joined/snapped together for example by way of interlocking tabs 15 providing at least a releasable attachment of the body 12 onto the exterior surface 4.

Figure 4:
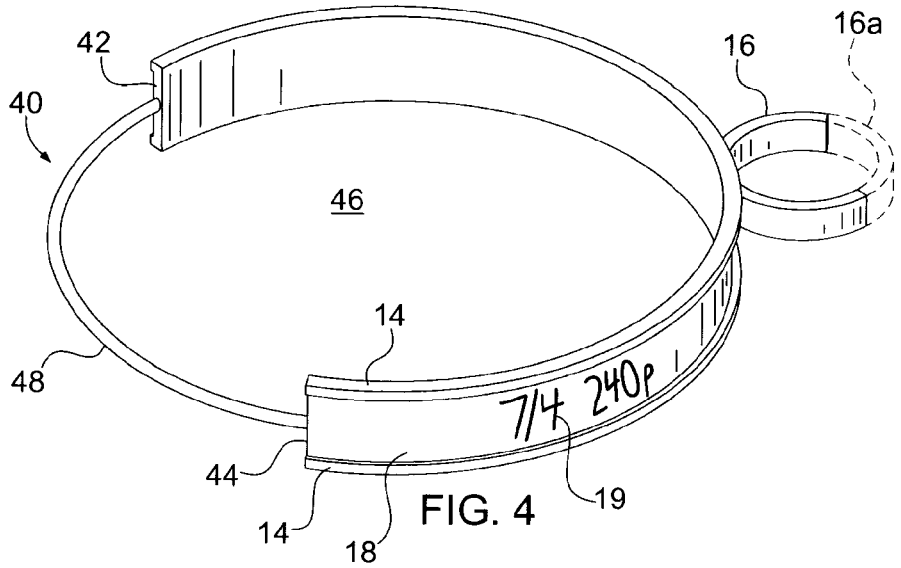
FIG. 4 illustrates one example of the article of manufacture of FIG. 1 with a marked-on surface and a marking implement holder.
Figure 5:
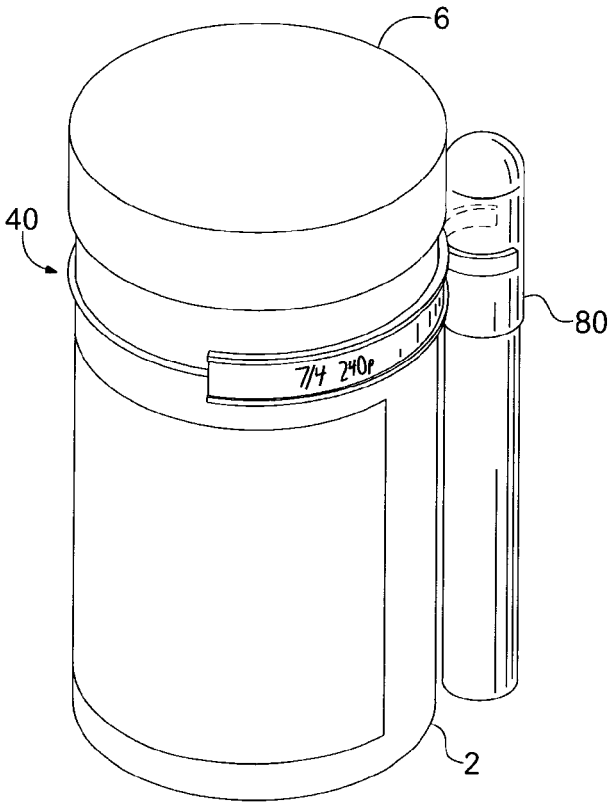
FIG. 5 illustrates another environmental view of the article of manufacture of FIG. 4 positioned on an exterior surface of a medicine dispensing container.

Now in a particular reference to FIGS. 4-5, the body 12 may be provided as a C-shaped member 40 having a pair of ends 42, 44 defining an interior opening 46. The C-shaped member 40 has a C-shaped cross-section in a plane transverse to the height of the body 12. The C-shaped member 40 may be manufactured from a resilient flexible material sufficient to grasp the exterior surface 4 of the medicine container 2 or an elastic band or strap 48 can be provided to connect ends 42, 44 so as to retain the C-shaped member 40 on the exterior surface 4 of the medicine container 2 in a manner that can prevent unintended separation of the article of manufacture from the exterior surface 4. The circumference of the C-shaped member 40 may be only enough to allow a sufficient length to write date and time, as shown in FIG. 4 and may further be sufficient to mark-on the dosage and even the name of the contents of the medicine container 2.

The clip 16, as shown in FIG. 4, may be a complete ring 16*a*.

Figure 6:
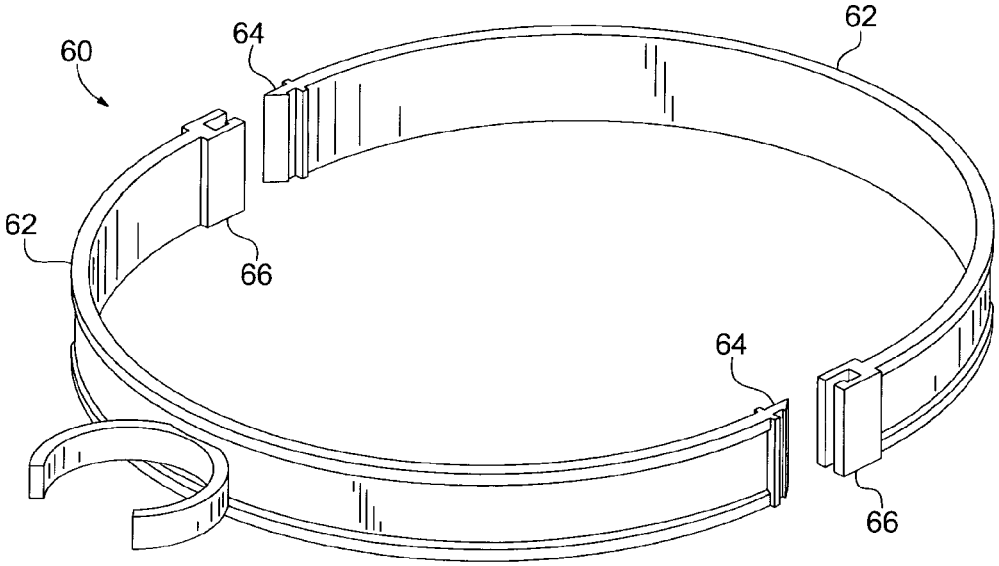
FIG. 6 illustrates another exemplary perspective view of an article of manufacture with a marking implement holding clip.

In a particular reference to FIG. 6, the article of manufacture is provided as a ring shaped member 60 and may comprise a pair of halves 62 with interlocking mating ends, illustrated as male end 64 and a female end 66 or any other suitable means. Similar mating arrangement is contemplated for ends of a single band in FIG. 3, or the interlocking tabs 15 may be employed with the halves 62 in place of the male end 64 and the female end 66.

Figure 7:
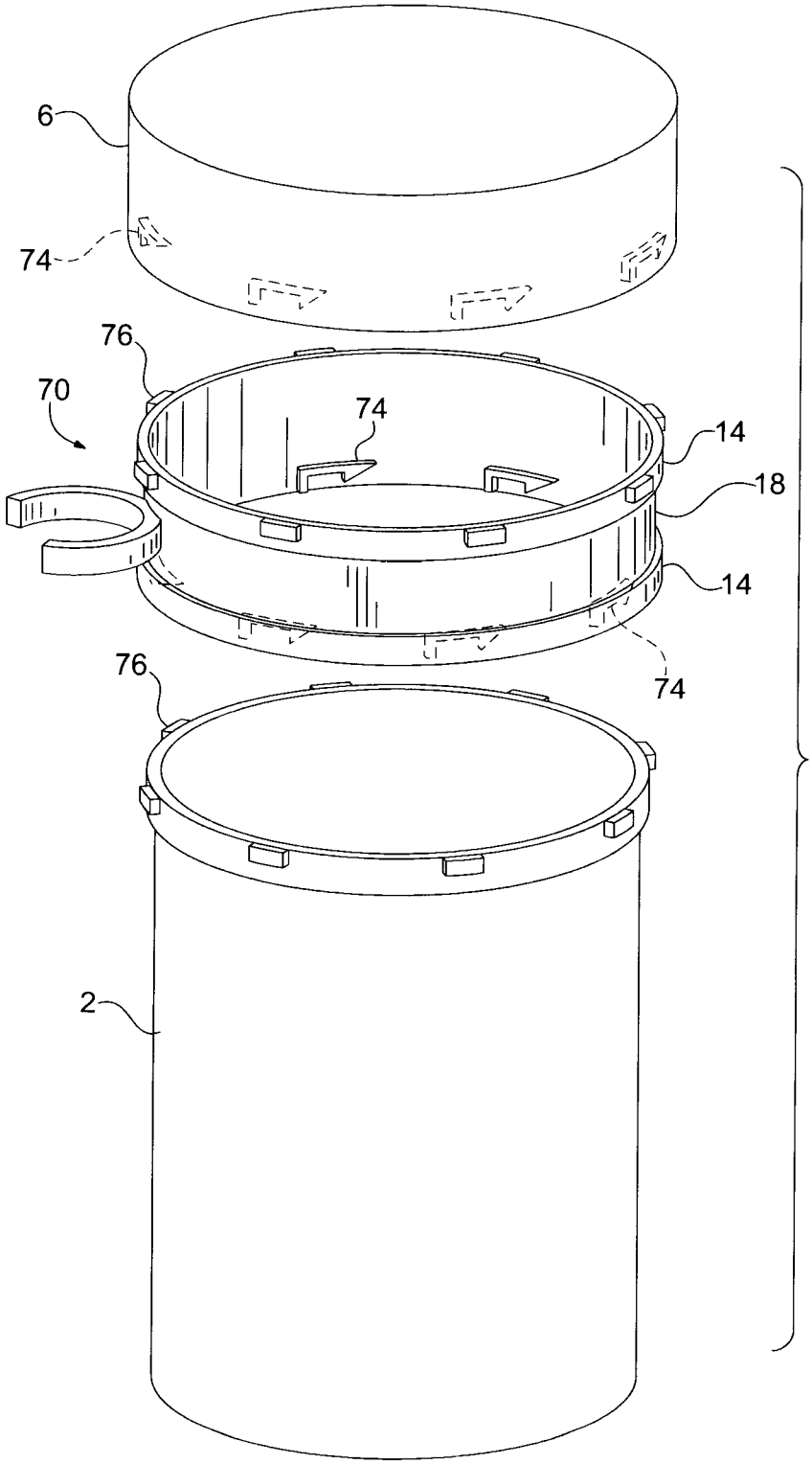
FIG. 7 illustrates an exploded perspective view of a ring shaped article of manufacture mountable between an open top of the container and the cap provided to selectively cover and uncover the open end.
Figure 8:
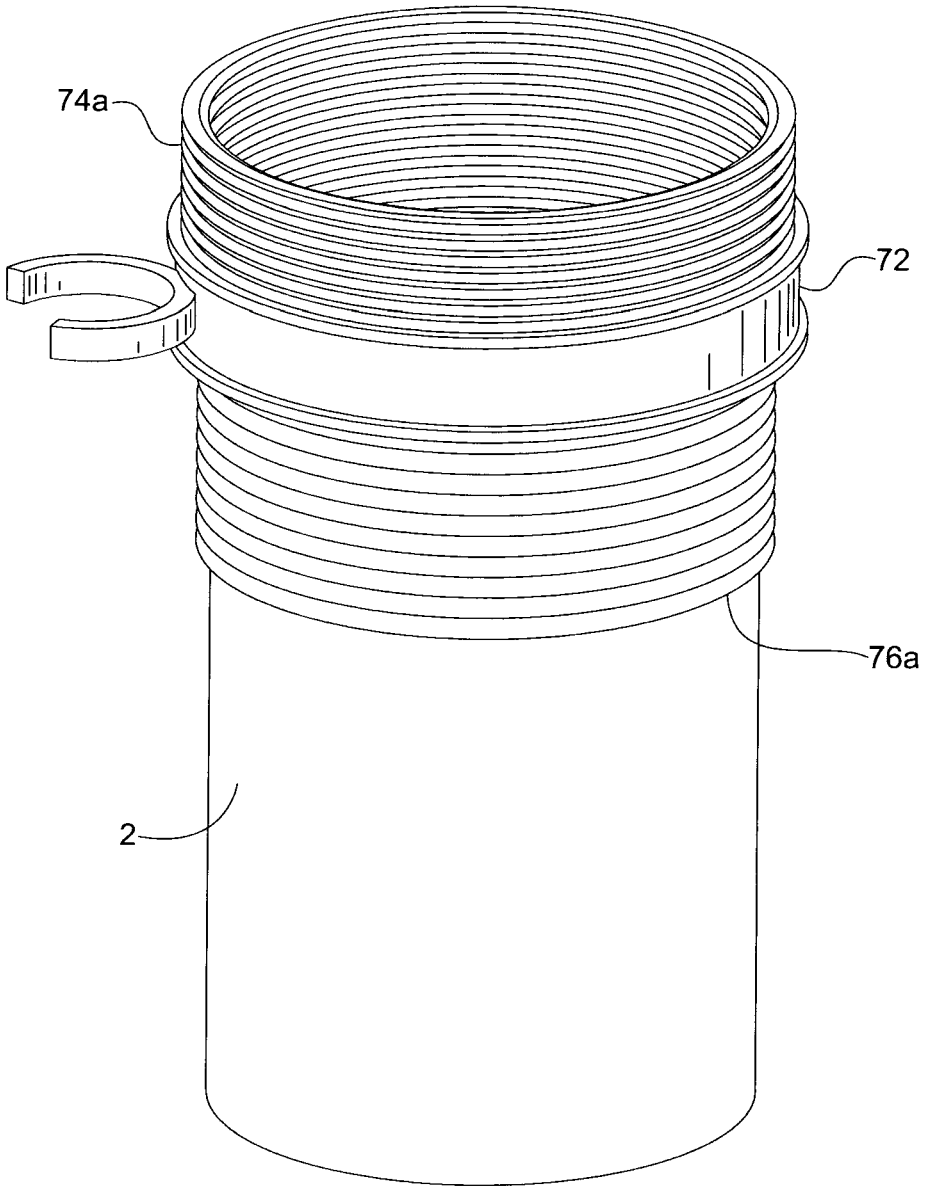
FIG. 8 illustrates yet another exemplary perspective environmental view of an article of manufacture with a marking implement holding clip adapted with a male and female threaded ends.

Now in a reference to FIGS. 7-8, the article of manufacture 70 may comprise a body 72 that defines an annular wall, with the article of manufacture 70 further comprising means for mounting the body 72 between an open top of the medicine container 2 and the cap 6 adapted to close the open end. In one example of FIG. 7, such means may include one or more tabs or lugs 74 disposed at each terminal end of the body 72 and operatively meshing with one or more complimentary tabs or lugs 76 provided on the cap 6 and the open end of the medicine container 2. The position of tabs or lugs 74 and tabs or lugs 76 may be reversed. In another example of FIG. 8, such means may include a male thread 74*a* disposed at one terminal end of the body 72 and a female thread 76*a* disposed at an axially opposite terminal end of the body 72 or even internal to the body 72 so as to reduce the overall length of the body 72, although an externally disposed thread 76*a* may increase the overall usable length of the medicine container 2.

Figure 9:
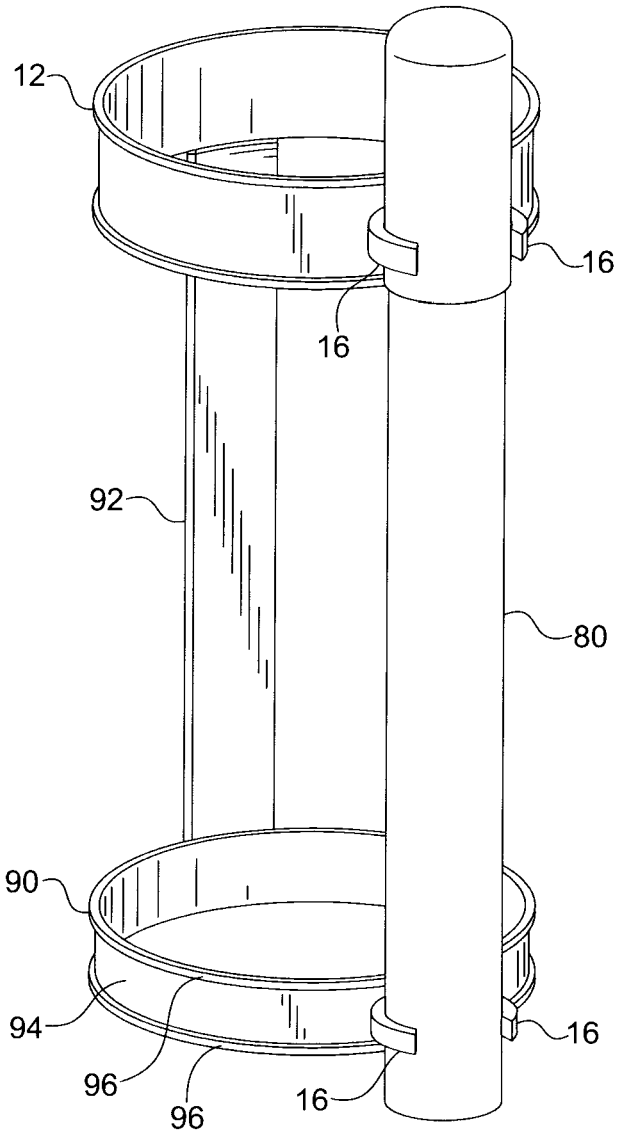
FIG. 9 illustrates a further another exemplary perspective view of an article of manufacture with a marked-on surface and a marking implement holder.

In a reference to FIG. 9, the article of manufacture may include another hollow body 90 spaced apart from the body 12 and a member 92 connected at one end thereof to the body 12 and connected at an opposite end thereof to the another hollow body 90. The article of manufacture may then further includes a first clip 16 or ring 16*a* disposed on the exterior surface of the body 12 and a second clip 16 or ring 16*a* disposed on an exterior surface of the another body 90, each of the first and second clips 16 or rings 16*a* configured to receive therewithin a portion of the marking implement 80. The body 90 may be configured to engage a lower portion of the medicine container 2, while the body 12 is adapted to engage the upper portion of the medicine container 2. The exterior surface 94 of the body 90 may be provided as a marked-on surface, similar to the surface 18, to receive an indicia identifier 19 thereon without binding and/or being absorbed thereby. The surface 96 may be provided as a non marked-on surface. The article of manufacture of FIG. 9 may further comprise flanges or tabs 96, particularly when such surface 94 is provided as a marked-on surface. The hollow body 90 may be manufactured entirely from a flexible resilient material, for example such as an elastomer, without an exterior marked-on surface 18 so as to alone provide for releaseable retention of the article of manufacture of FIG. 9 on the container (not shown). The another hollow body 90 may be provided in accordance with any one of the above described exampled, including, without a limitation, a C-shaped cross-section.

The medicine container 2 may include, without limitation, a tubular pill bottle, a liquid medicine bottle, a rectangular or square pill dispenser with one or more internal compartments, rectangular or square box package containing blister packs of medicines like Benadryl or cold medicine, and a cylinder shaped bottle. In the embodiments, exemplified in FIGS. 3 and 5, the medicine container 2 is illustrated as a conventional prescription medicine container.

It is also contemplated that the article of manufacture of any of the above examples can be adapted for attachment onto the exterior surface of the cap 6.

It is contemplated that the above described article of manufacture can be provided (sold) separately from the medicine container 2 or may be temporarily, releaseably or permanently secured to the exterior surface 4 of the medicine container 2.

It is further contemplated that any of the above described articles of manufacture may be of a disposable type to be used only once.

In operation, the user tasked with taking prescription and/or non-prescription medicine and/or supplements or a caregiver tasked to assist with taking or administer such medicine and/or supplements can easily record by marking/writing, with the marking implement 80, the date, time and/or quantity of the next dose immediately upon current dose being disposed of. The user or caregiver may also record the date, time and/or quantity of the dose just taken. The user or caregiver may also record the name of the medicine particularly where the letters are sized larger than those on the medicine container label (not shown).

The user or caregiver can easily review the information on any of the above marked-on surfaces to determine if a subsequent dose of medicine or a supplement may or should be administered.

If determined that the user or caregiver may or should administer a subsequent dose, the user or caregiver first erases all the information on the writing surface with any one of a hand, a cloth, or a compatible eraser, particularly when provided on the writing implement 80. Immediately or with some time gap, after administering the medicine or supplement, the user or caregiver writes the current time and date and/or amount on the marked-on surface with the writing implement 80. For example, if medicine was taken at 10:10 am, then the user or caregiver writes "10:10 am" and includes the current date. The amount or required dosage (as in the case of varying amounts of liquid fever reducers given to infants and children by weight) may also be recorded. The user or caregiver may also update Next Dose Due information at the same time. The information on the marked-on surface may be easily and conveniently reviewed at any time.

Although illustrated in a combination with a prescription medicine type container, any of the above described articles of manufacture can be shaped and sized for installation on any containers presently in use so as to aide in managing and tracking contents of such containers and their use, storage and/or handling. By way of one example only, any of the above described articles of manufacture can be used to mark an expiration date of cookies placed into a conventional "cookie jar".

Figure 10:
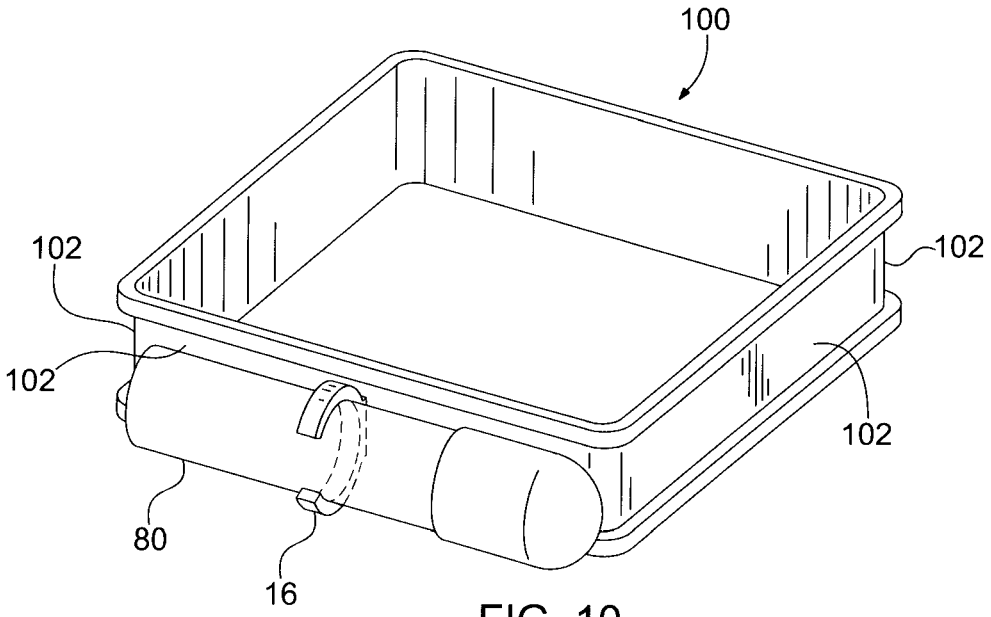
FIG. 10 illustrates another exemplary perspective view of an article of manufacture with a marked-on surface and a marking implement holder.

The cross-sectional shape of any of the above described bodies may be defined by one or more generally flat portions, for positioning on an exterior surface of a container having a square or rectangular cross-section. FIG. 10 illustrates an article of manufacture 100 that is provided as having a square cross-sectional shape consisting of four marked-on portions 102.

By way of an example, such article of manufacture 100 may be used on a container (not shown) suitable for storing a baking mix of ingredients with the marked-on surface being sufficiently sized and shaped not only to be used for indicating the name of the product and storage time frame but also for writing a recipe that uses the mix. Once the mix contents have been consumed, the container can be employed for storing a different product requiring different information to be written on a marking surface. In such examples, the body and/or the marking surface can define a rigid member with optional raised flange being provided on one or more terminal edges.

By way of another example, the container (not shown) can be of a shallow storage type suitable to refrigerate cooked leftovers where the user can record and track at least one of type, quantity, cooking date, storage duration and the like.

The article of manufacture 100 may be adapted with the above described interlocking tabs 15, elastic strap 48, interlocking ends 64, 66 or any other suitable means.

It is also contemplated that the clip 16, when provided, may be separated from any marked-on exterior surface. By way of one example only, the clip 16 may be affixed, either removeably or permanently, to the cap 6 or to a different portion of the medicine container 2.

Figure 11:
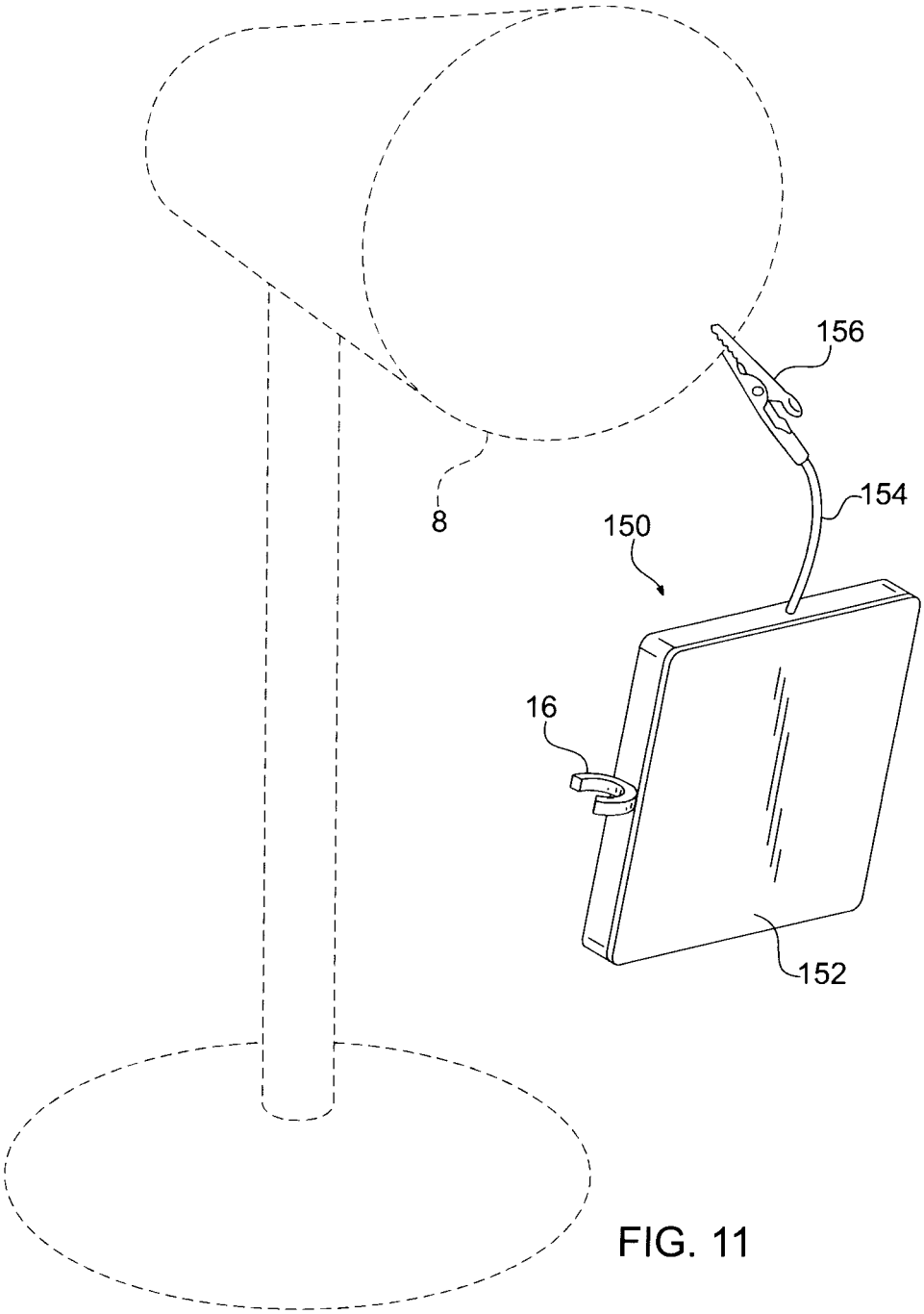
FIG. 11 illustrates another exemplary perspective view of an article of manufacture with a marked-on surface and a marking implement holder.

It is also contemplated by the instant invention that the elastic band or strap or any other suitable mounting arrangements, such as clamps, clips, hook and loop fasteners, snaps, buttons, pins, tacks, and the like, may be employed for attaching any of the above described articles of manufacture having a marked-on surface to any other permanent or movable structures and/or devices. For example, such article of manufacture 150 of FIG. 11, provided in a non-annular square shape, may be adapted with an alligator type clip/clamp 156 and a cord 154 to be at least temporarily affixed to a table lamp (or to an edge of a computer screen) for the marked-on surface 152 to be used for a note or message recording purposes and even as an alternative to well known "Post-it".™. notes. The clip 16 may be then positioned at one terminal edge so as to dispose the marking implement 80 along such one edge.

In any of the above examples, the exterior marked-on surface may be fabricated from a material that does not adhere or bind to the indicia identifier 19, including, without limitation, a dry-erase surface, a melamine surface, porcelain, painted steel, and hardened laminate. The exterior marked-on surface may be reused a multiplicity of times to reflect subsequent day, time and/or dosages of the medicine. The indicia identifier 19 is configured to adhere to any of the above marking surfaces without binding and/or being absorbed by any of the above marking surfaces. In some examples, the indicia identifier 19 may include, without limitation, a dry-wipe marker ink, an erasable ink, eraser mate inks, and toulene and xylene based inks. In some examples, the indicia identifier 19 may be a nontoxic erasable ink that easily and quickly erases from the marked-on exterior surface.

Any of the above described marked-on surfaces may be provided, in alternative examples, as a stack of such "Post-it". ™. notes.

It will be understood that the marking implement 80 can be selected from any conventional marking devices to complement the type of marked-on surface. So, for example, when any of the above described marked-on surfaces is provided as a dry-erase surface, marking implement 80 may be of a non-permanent marker type that will not allow permanent indicia identifier 19 on the dry-erase surface.

Thus, the present invention has been described in such full, clear, concise, and exact terms as to enable any person skilled in the art to which it pertains to make and use the same. It will be understood that variations, modifications, equivalents and substitutions for components of the specifically described examples of the invention may be made by those skilled in the art without departing from the spirit and scope of the invention as set forth in the appended claims. It is therefore intended that all matters in the foregoing description and shown in the accompanying drawings be interpreted as illustrative and not in a limiting sense.

What is claimed is:

1. An article of manufacture configured to be attached on an exterior surface of a container, said article of manufacture comprising:

a body comprising a C-shaped cross-section in a plane transverse to a height of said body and a pair of free ends defining an interior opening;

a member secured, with an adhesive, to an exterior surface of said body, said member comprising at least a portion of an exterior surface of said member configured for writing and erasing thereon;

a clip or a ring configured to receive a marking implement therewithin in a direction along said height of said body, the marking implement operable to adhere indicia onto said at least said portion of said exterior surface of said member configured for writing and erasing thereon;

an elastic band or strap connecting said pair of free ends so as to retain, during use of said article of manufacture, said C-shaped member body on the exterior surface of the container, sufficient to prevent an unintended separation of said article of manufacture from the exterior surface of the container; and a pair of flanges or abutments disposed on both terminal edges of said body and protruding above said exterior surface of said member configured for writing and erasing thereon.

2. The article of manufacture of claim 1, wherein said elastic band or strap is manufactured from a resilient material.

3. The article of manufacture of claim 1, wherein said member comprises one of a dry-erase surface, a melamine surface, a porcelain, a painted steel, and a hardened laminate.

4. An article of manufacture configured to be attached on an exterior surface of a container, said article of manufacture comprising:

a body comprising a C-shaped cross-section in a plane transverse to a height of said body and a pair of free ends defining an interior opening;

a member secured, with an adhesive, to an exterior surface of said body, said member comprising at least a portion of an exterior surface of said member configured for writing and erasing thereon;

a pair of flanges or abutments disposed on both terminal edges of said body and protruding above said exterior surface of said member configured for writing and erasing thereon;

a ring configured to receive a marking implement therewithin in a direction along said height of said body, the marking implement operable to adhere indicia onto said at least said portion of said exterior surface of said member configured for writing and erasing thereon; and an elastic band or strap connecting said pair of free ends so as to retain, during use of said article of manufacture, said C-shaped member body on the exterior surface of the container, sufficient to prevent an unintended separation of said article of manufacture from the exterior surface of the container.

* * * * *